US006329617B1

(12) United States Patent
Burgess

(10) Patent No.: US 6,329,617 B1
(45) Date of Patent: Dec. 11, 2001

(54) PRESSURE ACTIVATED SWITCHING DEVICE

(76) Inventor: Lester E. Burgess, Box 522, Swarthmore, PA (US) 19081

( * ) Notice: Subject to any disclaimer, the term of this patent is extended or adjusted under 35 U.S.C. 154(b) by 0 days.

(21) Appl. No.: 09/664,815

(22) Filed: Sep. 19, 2000

(51) Int. Cl.[7] ..... H01H 3/16

(52) U.S. Cl. ..... 200/61.43; 200/61.73; 200/512; 200/85 R

(58) Field of Search ..... 49/26–28; 200/61.41–61.44, 200/61.73, 511, 512, 85 R, 86 R, 86 A

(56) References Cited

U.S. PATENT DOCUMENTS

| | | | |
|---|---|---|---|
| 2,951,817 | 9/1960 | Myers | 252/511 |
| 3,315,050 | 4/1967 | Miller | 200/61.43 |
| 3,321,592 | 5/1967 | Miller | 200/61.43 |
| 3,634,334 | 1/1972 | Burgess | 252/514 |
| 3,668,337 | 6/1972 | Sinclair | 200/5 A |
| 3,693,026 | 9/1972 | Miller | 307/119 |
| 3,859,485 | 1/1975 | Blinkilde et al. | 200/85 A |
| 4,014,217 | 3/1977 | Lagasse et al. | 73/432 R |
| 4,051,336 | 9/1977 | Miller | 200/61.43 |
| 4,121,488 | 10/1978 | Akiyama | 84/1.01 |
| 4,137,116 | 1/1979 | Miller | 156/269 |
| 4,143,367 | 3/1979 | Schestag | 340/540 |
| 4,172,216 | 10/1979 | O Shea | 200/85 R |
| 4,200,777 | 4/1980 | Miller | 200/85 A |
| 4,273,974 | 6/1981 | Miller | 200/61.43 |
| 4,349,710 | 9/1982 | Miller | 200/61.43 |
| 4,481,815 | 11/1984 | Overton | 73/432 R |
| 4,497,989 | 2/1985 | Miller | 200/86 R |
| 4,620,072 | 10/1986 | Miller | 200/81 R |
| 4,640,137 | 2/1987 | Trull et al. | 73/862.04 |
| 4,661,664 | 4/1987 | Miller | 200/86 R |
| 4,785,143 | 11/1988 | Miller | 200/61.43 |
| 4,837,548 | 6/1989 | Lodini | 338/47 |
| 4,845,323 | 7/1989 | Beggs | 200/85 R |
| 4,876,419 | 10/1989 | Lodini | 200/86 R |
| 4,876,420 | 10/1989 | Lodini | 200/86 R |
| 4,900,497 | 2/1990 | Lodini | 264/104 |
| 4,908,483 | 3/1990 | Miller | 200/61.43 |
| 4,920,241 | 4/1990 | Miller | 200/86 R |
| 4,951,985 | 8/1990 | Pong et al. | 293/102 |
| 4,954,673 | 9/1990 | Miller | 200/61.43 |
| 4,964,302 | 10/1990 | Grahn et al. | 73/865.7 |
| 4,972,054 | 11/1990 | Miller et al. | 200/61.43 |
| 4,977,386 | 12/1990 | Lodini | 338/114 |
| 5,010,774 | 4/1991 | Kikuo et al. | 73/862.04 |
| 5,019,797 | 5/1991 | Marstiller et al. | 338/333 |
| 5,019,950 | 5/1991 | Johnson | 362/130 |

(List continued on next page.)

FOREIGN PATENT DOCUMENTS

| | | | |
|---|---|---|---|
| 1 942 565 | 4/1971 | (DE) . | |
| 2 026 894 | 12/1971 | (DE) | G08B/13/10 |
| 0 167 341A2 | 1/1986 | (EP) | H01B/7/10 |
| 0 293 734A1 | 12/1988 | (EP) | H01H/3/14 |
| 2 045 527A | 10/1980 | (GB) | H01H/13/16 |

*Primary Examiner*—Michael Friedhofer
(74) *Attorney, Agent, or Firm*—Dilworth & Barrese

(57) ABSTRACT

A pressure activated switching device includes a first conductive layer, a second conductive layer spaced apart from the first conductive layer so as to define a planar space therebetween, and a standoff layer of electrically insulative material positioned between the first and second conductive layers. The standoff layer includes at least one opening for permitting movement therethrough of one or the other of said first and second conductive layers for the purpose of making electrical contact between them. The opening is defined by an interior edge of the standoff which laterally circumscribes an interior space, the opening including at least one linear, finger-like projection extending laterally from the interior edge into the interior space. Optionally, the switching device can include a piezoresistive material positioned between a conductive layer and the standoff. The pressure activated switching device can be used, for example, in a safety sensing edge system for a movable door.

25 Claims, 5 Drawing Sheets

U.S. PATENT DOCUMENTS

| | | | | |
|---|---|---|---|---|
| 5,023,411 | | 6/1991 | Miller et al. | 200/61.43 |
| 5,027,552 | | 7/1991 | Miller et al. | 49/27 |
| 5,060,527 | | 10/1991 | Burgess | 73/862.68 |
| 5,066,835 | | 11/1991 | Miller et al. | 200/61.43 |
| 5,072,079 | | 12/1991 | Miller | 200/61.43 |
| 5,089,672 | | 2/1992 | Miller | 200/61.43 |
| 5,132,583 | | 7/1992 | Chang | 310/339 |
| 5,260,530 | * | 11/1993 | Duhon et al. | 200/86 R |
| 5,264,824 | | 11/1993 | Hour | 340/384 E |
| 5,477,217 | | 12/1995 | Bergan | 340/933 |
| 5,510,812 | | 4/1996 | O Mara et al. | 345/61 |
| 5,623,760 | * | 4/1997 | Newham | 29/622 |
| 5,695,859 | | 12/1997 | Burgess | 428/209 |
| 5,828,289 | | 10/1998 | Burgess | 338/47 |
| 5,855,615 | | 3/1999 | Burgess | 338/114 |
| 5,856,644 | | 1/1999 | Burgess | 200/61.43 |
| 5,910,355 | | 6/1999 | Burgess | 428/209 |
| 5,962,118 | | 10/1999 | Burgess | 428/308.4 |
| 5,967,299 | * | 10/1999 | de Richecour et al. | 200/512 |
| 6,072,130 | | 6/2000 | Burgess | 200/86 R |
| 6,114,645 | | 9/2000 | Burgess | 200/512 |
| 6,121,869 | | 9/2000 | Burgess | 338/99 |
| 6,172,315 | * | 1/2001 | Miller et al. | 200/61.73 |

* cited by examiner

PRESSURE ACTIVATED SWITCHING DEVICE

BACKGROUND OF THE INVENTION

1. Field of the Invention

The present invention relates to a pressure activated switching device for closing or opening an electric circuit, and particularly to a safety edge for opening or stopping the movement of a door in response to contact with an object in its path.

2. Background of the Art

Pressure activated electrical switches are known in the art. Typically, such switches are used as floor mats to open or close electrical circuits. For example, floor mat switches may be placed in the vicinity of machinery to halt its operation if anyone is in dangerous proximity to the machinery. Another use for pressure activated switching devices is as safety edges for doors. Motorized doors, (for example, in garages, factories, aircraft hangars, trains, elevators, etc.) pose a hazard to persons who may be in the path of the door as it is closing. Accordingly, such doors are typically fitted with force sensing switches along their leading edges. When the door contacts an object in its path the switch closes in response to the contact pressure. Closure of the switch can be used to send a signal to the door controller to stop or reverse the motion of the door.

Various types of force sensing switches, or "sensing edges" are known. Typically such switches include electrified conductive strips separated by a void space and/or a resilient standoff (e.g. polymeric foam). When pressure is applied to the switch, as for example when it contacts an object in the path of the moving door, the conductive strips are compressed toward each other and make contact, thereby closing an electric circuit.

For example, U.S. Pat. No. 4,396,814 to Miller discloses a safety edge switching device for a door wherein a resiliently compressible structure is enclosed in a flexible, impervious sheet covering, and the interior compartment is airtight, forming a pressurized cell. The device employs a foam layer of intermittent regularly spaced grids which expose the faces of upper and lower conductive strips. The grids are defined by two parallel portions of the foam connected by a plurality of crosspieces extending laterally from one side portion to the other, thereby forming a ladder-like pattern with spaces which are not interconnected. Upon compression, upper and lower conductive strips make electrical contact with each other through the one or more spaces in the foam layer.

Other sensing edges for doors are disclosed, for example, in U.S. Pat. Nos. 5,832,665, 5,728,984, 5,693,921, 5,426,293, 5,418,342, 5,345,671, 5,327,680, 5,299,387, 5,265,324, 5,262,603, 5,260,529, 5,225,640, 5,148,911, 5,089,672, 5,072,079, 5,066,835, 5,027,552, 5,023,411, 4,972,054, 4,954,673, 4,920,241, 4,908,483, 4,785,143, 4,620,072, 4,487,648, 4,349,710, 4,273,974, 4,051,336, 3,896,590, 3,855,733, 3,462,885, 3,321,592, 3,315,050, and 3,133,167.

While the known sensing edges have performed a useful function, there yet remains a need for a simply constructed, sensitive, but durable sensing edge for a door.

SUMMARY

A pressure activated switching device is provided herein which comprises: a first conductive layer; a second conductive layer spaced apart from the first conductive layer so as to define a planar space therebetween; and a standoff layer of electrically insulative material positioned between the first and second conductive layers. The standoff layer includes at least one opening for permitting movement therethrough of one or the other of said first and second conductive layers, the opening being defined by an interior edge of the standoff which laterally circumscribes an interior space. The opening includes at least one linear projection extending laterally from the interior edge into the interior space and can be shaped and configured for appropriateness to the intended use of the pressure activated switching device.

BRIEF DESCRIPTION OF THE DRAWINGS

Various embodiments are described herein with reference to the drawings wherein.

DETAILED DESCRIPTION OF PREFERRED EMBODIMENT(S)

The terms "insulating", "conducting", "resistance", and their related forms are used herein to refer to the electrical properties of the materials described, unless otherwise indicated. The terms "top", "bottom", "above", and "below", are used relative to each other. The terms "elastomer" and "elastomeric" are used herein to refer to material that can undergo at least 10% deformation elastically. Typically, "elastomeric" materials suitable for the purposes described herein can include polymeric materials such as elastomeric polyurethane, plasticized polyvinyl chloride, and silicone, and other synthetic and natural rubbers, and the like.

As used herein the term "piezoresistive" refers to a material having an electrical resistance which decreases in response to compression caused by mechanical pressure applied thereto in the direction of the current path. Such piezoresistive materials can be, for example, resilient cellular polymer foams with conductive coatings covering the walls of the cells.

"Resistance" refers to the opposition of the material to the flow of electric current along the current path in the material and is measured in ohms. Resistance increases proportionately with the length of the current path and the specific resistance, or "resistivity" of the material, and it varies inversely to the amount of cross sectional area available to the current. The resistivity is a property of the material and may be thought of as a measure of (resistance/length)/area. More particularly, the resistance may be determined in accordance with the following formula:

$$R=(\rho L)/A \qquad \text{(I)}$$

where

R=resistance in ohms

ρ=resistivity in ohm-inches

L=length in inches

A=area in square inches

The current through a circuit varies in proportion to the applied voltage and inversely with the resistance, as provided in Ohm's Law:

$$I=V/R \quad \text{(II)}$$

where

I=current in amperes

V=voltage in volts

R=resistance in ohms

Typically, the resistance of a flat conductive sheet across the plane of the sheet, i.e., from one edge to the opposite edge, is measured in units of ohms per square. For any given thickness of conductive sheet, the resistance value across the square remains the same no matter what the size of the square is. In applications where the current path is from one surface to another of the conductive sheet, i.e., in a direction perpendicular to the plane of the sheet, resistance is measured in ohms.

The pressure activated switching device described herein can be used in conjunction with floor mat switches, and is especially suitable for use in a safety edge switch for a door, particularly a motorized door of the sliding type (garage door, train door, factory door, elevator door, aircraft hangar door, and the like) as well as in a motorized revolving door.

Figure 1:
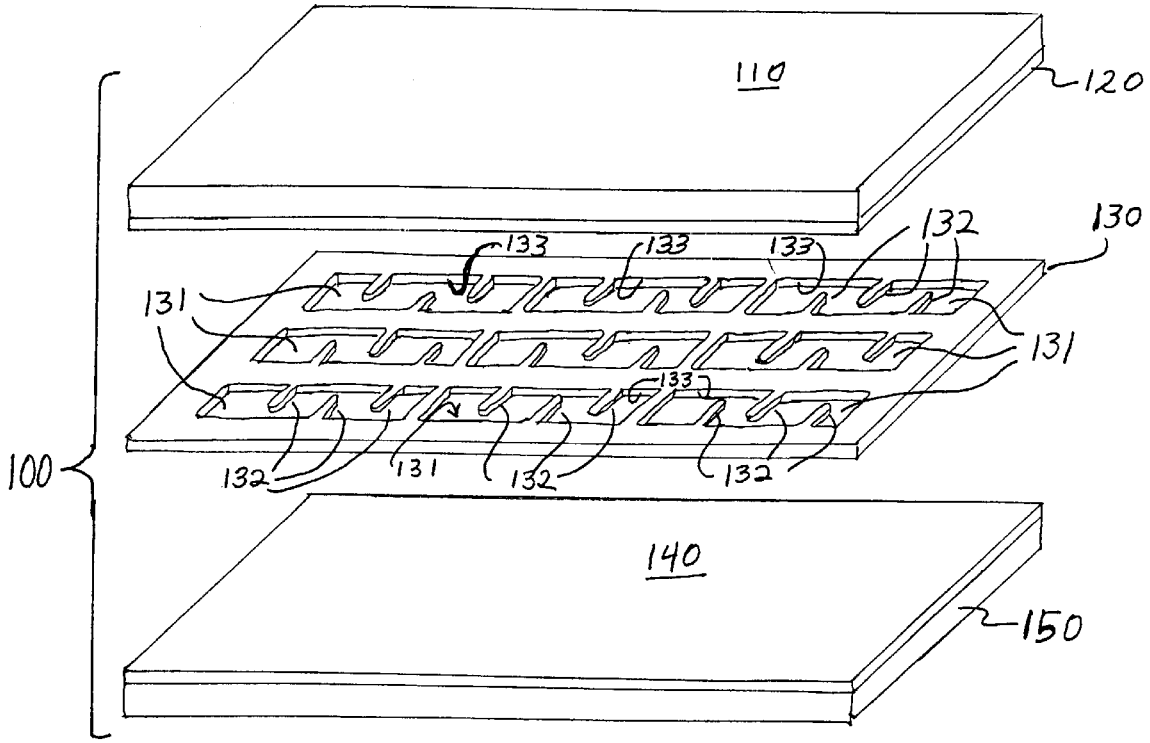
FIG. 1 is an exploded perspective view of the pressure activated switching device of the present invention.
Figure 2:
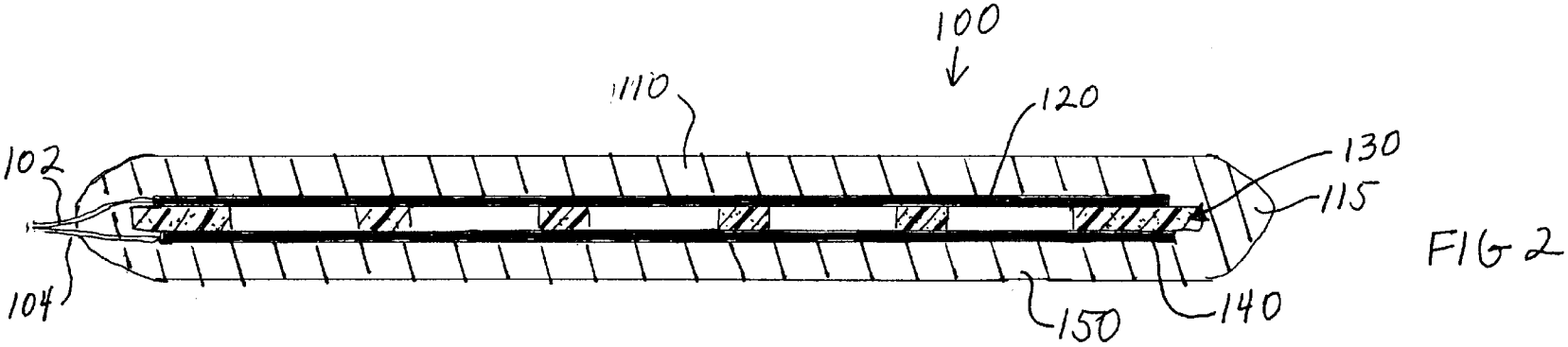
FIGS. 2 and 3 are sectional side views illustrating the switching device in the inactivated and activated conditions, respectively.

Referring now to FIGS. 1, and 2, the pressure activated switch 100 includes an upper cover layer 110, a base 150, upper and lower conductive layers 120 and 140, and a standoff, i.e. spacer element 130.

More particularly, cover layer 110 and base 150 are each sheets of any type of durable electrically insulative material capable of withstanding repeated applications of pressure and stresses under the operating conditions of the pressure activated switch 100. For example, cover layer 110 and base 150 can be fabricated from plastic or elastomeric materials. Preferred materials include natural or synthetic rubber, or other materials such as thermoplastic polymers, for example, polyurethane, silicone, and polyvinyl chloride ("PVC") sheeting. The sheeting can be relatively rigid or flexible to accommodate various environments or applications. The cover layer 110 and base 150 can be adhesively bonded or heat sealed around 1Q the periphery to form an hermetical seal for enclosing an interior space in which is positioned the components of switch 100 described below. The cover layer 110 and base 150 generally can range in thickness from about 1/64" to ½", preferably ⅛" to ¼" (although other thicknesses may also be used when appropriate), and can be embossed, ribbed, or smooth surfaced. The cover layer 110 and base 150 can be of the same or different material, the same or different thickness, and have the same or different surface features.

Conductive layers 120 and 140 can be metallic foil, conductive coating, or conductive film applied to the interior surfaces of the cover 110 and base 150, respectively. Optionally, one or both of conductive layers 120 and 140 can be elastomeric. Elastomeric conductive layers can be fabricated from a polymeric elastomer which contains conductive filler such as finely powdered metal or carbon. A suitable conductive elastomeric material for use in the present invention is disclosed in U.S. Pat. No. 5,069,527, which is herein incorporated by reference. Conductive layers 120 and 140 are spaced apart from each other so as to define a planar space therebetween.

Conductive layers 120 and 140 are each connected to a wire lead 102 and 104, respectively. Wires 102 and 104 extend outside the switch 100 and can be electrically connected to control equipment to incorporate switch 100 into a control circuit. A current applied to leads 102, 104 will flow when conductive layers 120 and 140 are in contact, thereby forming a closed electric circuit.

The standoff 130 of the present invention includes a sheet of electrically insulative material which can be rigid or flexible and which has openings 131 which can be penetrated by one or both of conductive layers 120 and 140 to make electrical contact therebetween. For example, the standoff can be fabricated from a solid (i.e., nonporous) synthetic polymer or natural rubber which can be rigid or elastomeric. However, the standoff is preferably resiliently flexible and capable of collapsing under a mechanical pressure and returning to its original size and configuration when the pressure is removed. The preferred material for fabricating the resiliently flexible standoff is an elastomeric polymeric or rubber foam. Polymeric or rubber foams are cellular materials formed by expanding a resin with a foaming agent prior to or during curing, as discussed below. The elastomeric foam applies a resilient biasing force to separate the two conductive layers 120 and 140 while the switch 100 is in the inactivated configuration.

Figure 3:
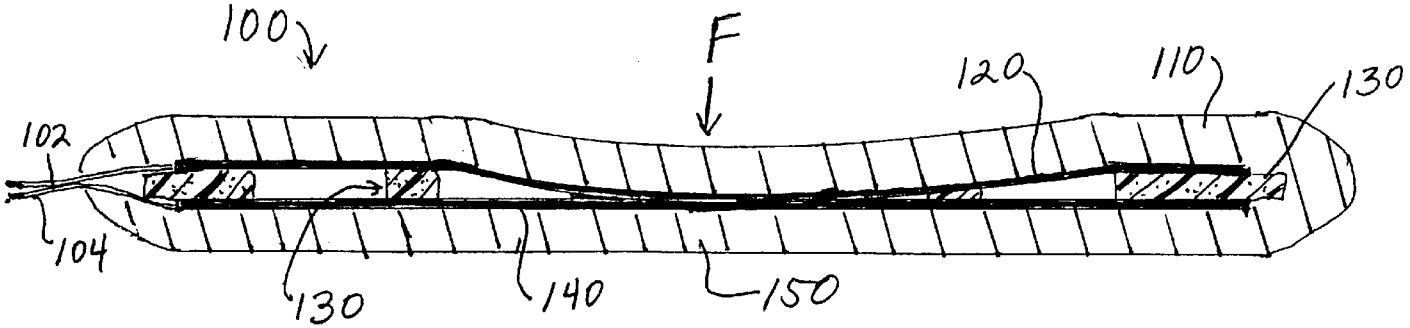

Referring also now to FIG. 3, when the switch 100 is activated, i.e., when an external force F is applied to the top surface, the conductive layers 120 and 140 are moved toward each other against the biasing force of the foam standoff 130. If sufficient force is applied the conductive layers 120 and 140 will contact each other through the openings 131 in the standoff 130. Closure of the circuit sends a signal to the control equipment to initiate, alter, or cease operation of equipment.

When the mechanical pressure is removed, the resilient biasing force of the elastomeric foam standoff 130 moves conductive layers 120 and 140 apart, thereby re-opening the electric circuit.

The threshold value of force is the minimum amount of externally applied force necessary to activate the device and is a measure of its sensitivity. The threshold value depends, at least in part, on the thickness of the standoff, its rigidity, and configuration as well as the opening size and configuration (e.g., oblong, square, circular or other shape).

Use of polymeric or rubber foam as a standoff provides an advantage over rigid, non-collapsible, standoffs. Sensitivity of the device to smaller mechanical pressures is increased and "dead space" around the standoff is decreased. Dead space is the area in which the upper and lower conductive layers 120 and 140 cannot make contact. Dead space can occur, for example, because the conductive layers cannot bend sharply around rigid standoffs.

The elastomeric foam can be open-celled or closed-celled and can be fabricated from any suitable material such as natural rubber, silicone rubber, plasticized PVC, thermoplastic or thermoset polyurethane, and the like. Typically such resins are expanded by means of a foaming agent to produce a cellular material. Foaming, agents typically produce gasses when activated, and methods for producing polymeric foams are well known in the art.

Typically, the density of uncompressed elastomeric foam can range from about 1 pound per cubic foot ("pcf") to about 20 pcf. Void space as a percentage of total volume of uncompressed polymer foam can range from less than about 30% to more than 90%. Consequently, when the foam standoff collapses under pressure, the volume is correspondingly reduced. The conductive layers can come into contact with each other without having to bend sharply around the standoff. The greater the density (and correspondingly lesser void space) the greater the strength of the foam and its resistance to compression. Generally, a density of 2 pcf to 15 pcf for uncompressed foam is preferred. The thickness of the foam standoff can be selected to provide more or less sensitivity.

A significant feature of standoff 130 herein is its configuration, which, among other advantages, facilitates the use of a greater range of standoff thicknesses.

The standoff of the present invention includes openings which are each defined by an interior edge of the standoff sheet which completely circumscribes an interior space. The openings include linear, finger-like projections which extend laterally into the interior space.

Referring again now to FIG. 1, standoff 130 includes openings 131, each being defined by a respective interior edge 133 of the standoff sheet 130. The interior edge 133 circumscribes and defines a laterally surrounded generally elongated interior space. Openings 131 are aligned lengthwise so as to generally define a longitudinal direction. Linear projections 132 extend laterally from the interior edges 133 and traversely to the longitudinal direction. Preferably, all of the linear projections 132 are substantially parallel to each other, although a non-parallel relationship between linear projections 132 is also contemplated. The linear projections 132 in an opening 131 preferably extend alternatively from one or the other of the major sides of the respective opening 131 so as to define an interdigitated pattern. As can be seen, the end of a linear projection 132 extending from one side is spaced apart from the opposite side edge so as to define a gap therebetween This gap allows the flow of air (or other gas) therethrough from one portion of the opening 131 to another. The standoff configuration described herein allows the range of standoff thicknesses to be broadened. Whereas the typical thicknesses of prior known standoffs ranged from about 1/32 inches to about 2 inches, standoff 130 can retain good functional characteristics up to about 6 inches in thickness. Thus, depending upon the particular, application, a suitable thickness for standoff 130 can range from about 1/64 inches to about 6 inches, preferably from about 1/32 inches to about 2 inches, from about 2 inches to about 4 inches, and/or from about 4 inches to about 6 inches. Another advantage is that opening 131 can be as much as about 12inches in lateral dimension or length. Thus, the length of individual openings 131 can optionally range from about 1/64 inches to about 12 inches, from about 1/16 inch to about 2 inches, from about 2 inches to about 4 inches, from about 4 inches to about 6 inches, and/or from about 6 inches to about 12 inches.

Figure 4:
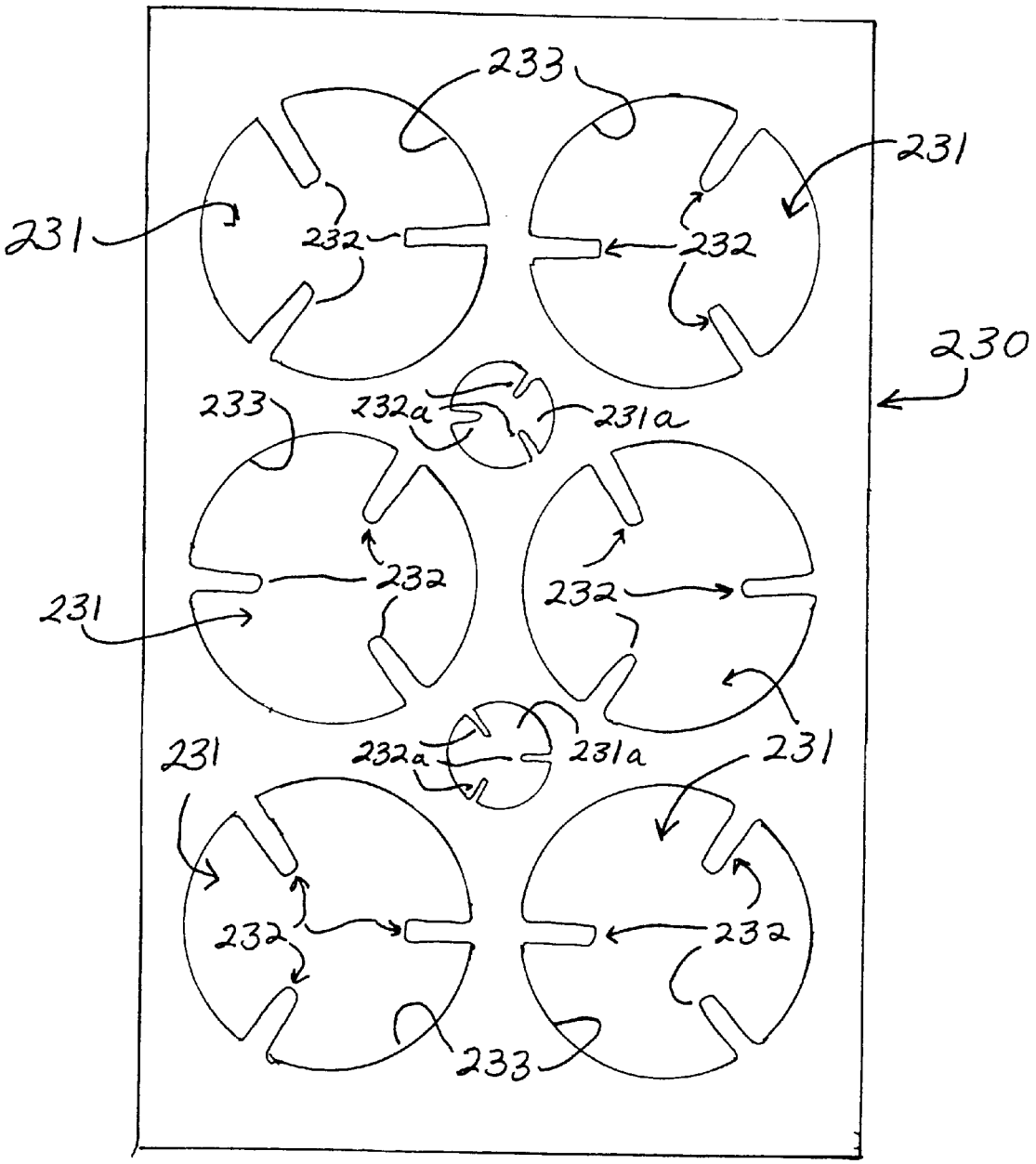
FIG. 4 is a plan view of an alternative standoff.

Referring now to FIG. 4, an alternative embodiment 230 of the standoff is illustrated. Standoff 230 can be fabricated from the same materials as indicated above for standoff 130. Standoff 230 is characterized by circular openings 231 which can be of the same or different sizes and can be arranged in a particular order or randomly. As shown in FIG. 4, standoff 230 includes smaller diameter openings 231*a* in addition to the larger diameter openings 231. The diameter of openings 231 (or 231*a*) can range from about 1/32 inches to about 12 inches. Optionally the diameter of the openings 231 (or 231*a*) can range from about 1/32 inches to 20 about 2 inches, from about 2 inches to about 4 inches, from about 4 inches to about 8 inches, and/or from about 8 inches to about 12 inches. Linear finger-like projections 232 extend inwardly from the circular edge 233 which defines the outer periphery of openings 231. Preferably, projections 232 are oriented radially inward and are equally spaced, although other spacing arrangements and angles may be employed. Projections 232*a* extend inward in circular openings 231*a* in a corresponding manner. The thickness of standoff 230 can be characterized by the same ranges as indicated above for standoff 130.

Figure 5:
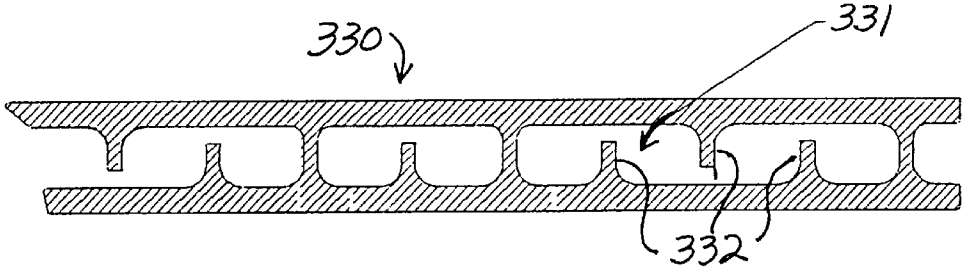
FIG. 5 is a plan view illustrating a standoff configuration suitable for use in a safety edge switch for a door.
Figure 7:
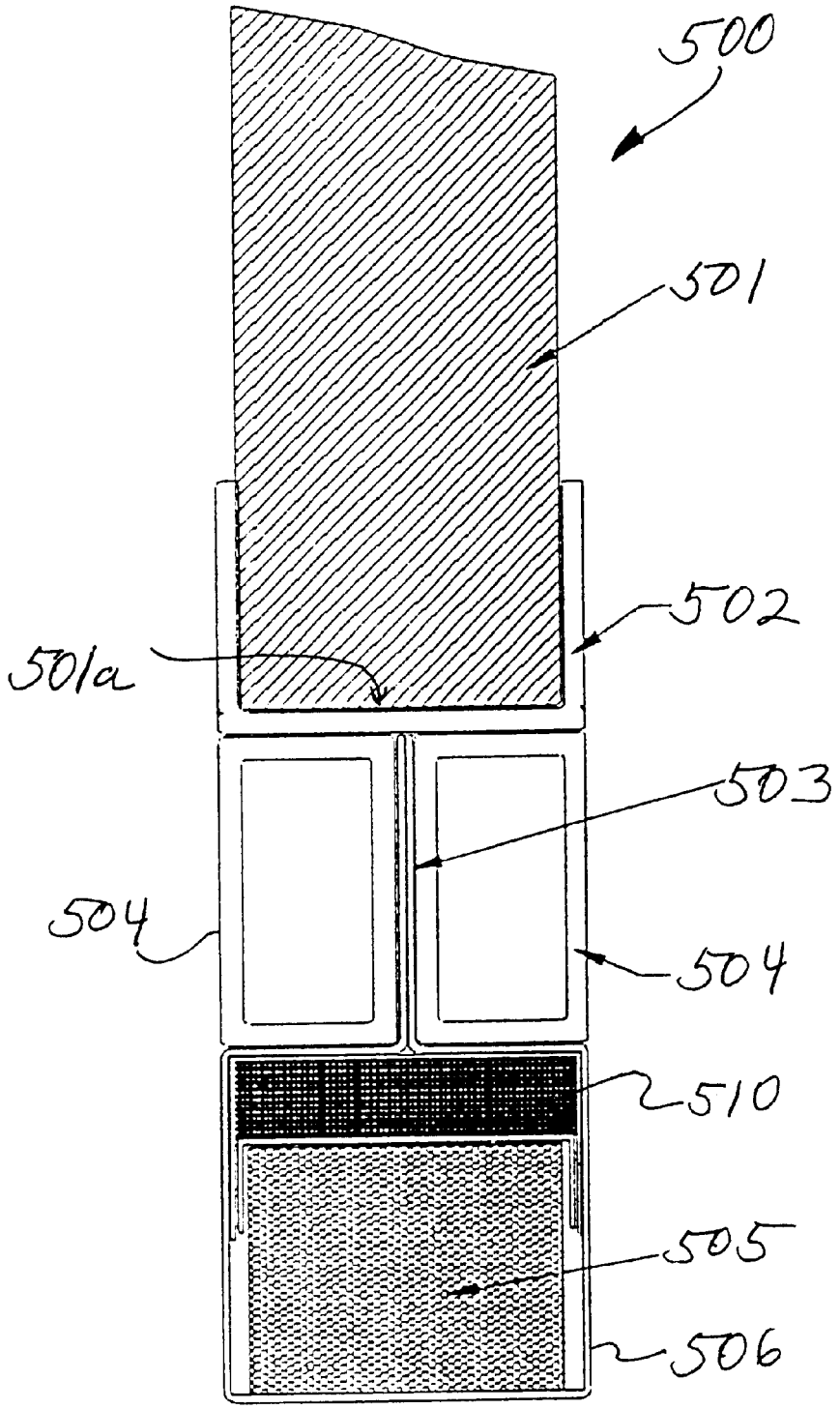
FIG. 7 is a diagrammatic sectional view illustrating a safety sensing edge system for a door.

Referring now to FIG. 5 standoff 330 is particularly suitable for use in a safety edge switch for a door, as shown in FIG. 7. Standoff 330 includes a strip having a single row of rectangular openings 331 arranged longitudinally and end to end. The openings 331 include interdigitated laterally oriented linear projections 232.

Figure 6:
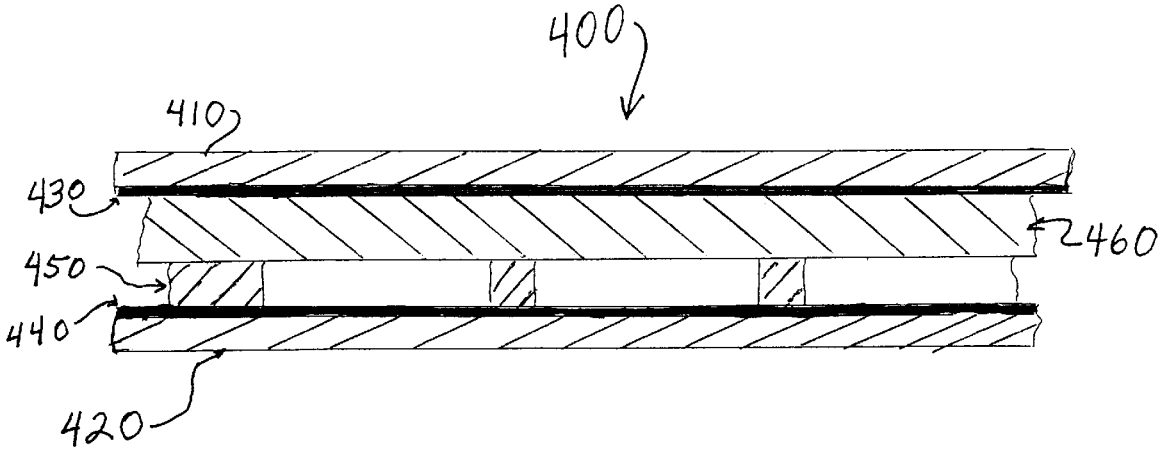
FIG. 6 is a sectional side view of an alternative embodiment of the invention which employs a piezoresistive layer.

In yet another embodiment the pressure activated switching device can include a piezoresistive material between one conductive layer and the interdigitated standoff. Referring now to FIG. 6, pressure activated switching device 400 includes cover layer 410 and base 420 fabricated of PVC sheeting or other suitable material such as polyurethane or rubber in a manner similar to that of pressure activated switching device 100. Likewise, pressure activated switching device 400 includes conductive layers 430 and 440 similar to corresponding conductive layers 120 and 140 of pressure activated switching device 100. Standoff 450 includes openings with linear projections such as standoffs 130, 230 or 330 as described above, and is preferably made of polymeric or rubber foam, although rigid or elastomeric solid standoffs made of, for example, synthetic polymer or natural rubber are also serviceable.

The piezoresistive layer 460 is cellular polymeric material which has been rendered conductive by, for example, incorporating conductive filler (e.g. metal powder, graphite) into the polymeric structure. One way to fabricate such a piezoresistive material is to introduce a conductive coating material into the void spaces of a pre-expanded polymer foam to coat the inside surfaces of the cells. Such piezoresistive materials are limited to open-celled foams to permit the interior cells of the foam to receive the conductive coating.

Another way to fabricate a cellular material, but without expansion, is to incorporate leachable particles into an uncured resin, such as silicone. The resin is then allowed to cure, after which the leachable particles are dissolved out of the polymer by a suitable solvent to leave a cellular mass.

An alternative conductive piezoresistive polymer foam suitable for use in the present invention is an intrinsically conductive expanded polymer (ICEP) cellular foam comprising an expanded polymer with premixed filler comprising conductive finely divided (preferably colloidal) particles and conductive fibers.

An intrinsically conductive expanded foam differs from the prior known expanded foams in that the foam matrix is itself conductive. The difficulty in fabricating an intrinsically conductive expanded foam is that the conductive filler particles, which have been premixed into the unexpanded polymeric resin spread apart from each other and lose contact with each other as the resin is expanded by the foaming agent, thereby creating an open circuit.

Surprisingly, the combination of conductive finely divided powder with conductive fibers allows the conductive filler to be premixed into the resin prior to expansion without loss of conductive ability when the resin is subsequently expanded. The conductive filler can comprise an effective amount of conductive powder combined with an effective amount of conductive fiber. By "effective amount" is meant an amount sufficient to maintain electrical conductance after expansion of the foam matrix. The conductive powder can be powdered metals such as copper, silver, nickel, gold, and the like, or powdered carbon such as carbon black and powdered graphite. The particle size of the conductive powder typically ranges from diameters of about 0.01 to about 25 microns. The conductive fibers can be metal fibers or, preferably, graphite, and typically range from about 0.1 to about 0.5 inches in length. Typically the amount of conductive powder range from about 15% to about 80% by weight of the total composition. The conductive fibers typically range from about 0.1% to about 10% by weight of the total composition.

The intrinsically conductive foam can be made according to the procedure described in U.S. Pat. No. 5,695,859, which is herein incorporated by reference. A significant advantage of intrinsically conductive foam is that it can be a closed cell foam, or an open celled foam.

As mentioned above, the resistance of the piezoresistive material decreases as the piezoresistive material is compressed under mechanical pressure. Hence, when part of an electric circuit, the piezoresistive material provides a way to measure the force applied to it by measuring the current flow.

The standoff 450, which is an insulator, provides an on-off function. As can be seen from FIG. 6, the piezoresistive material 460 is in contact with upper conductive layer 430. The insulative standoff 450 is positioned between piezoresistive layer 460 and the lower conductive layer 440. In the absence of compressive force there is no contact between the piezoresistive layer 460 and the lower conductive layer 440. Upon application of a compressive force to the upper surface of cover layer 410 the standoff 450 compresses. When a threshold level of compressive force is applied the piezoresistive layer 460 makes contact with the lower conductive layer 440 through the spaces in the standoff 450 and the switching device 400 is activated, i.e. a current flows through a closed circuit. Thereafter, any additional force beyond the threshold level registers as an increase in the current flow. Thus, the magnitude of the compressive force can be measured. The sensitivity of the switching device 400, i.e. its responsiveness to low threshold force, depends, at least in part, on the thickness of the standoff and its resistance to compression.

FIG. 7 illustrates a safety sensing edge system 500 for a door. Door 501 can be any type of moving door, and is typically a motorized sliding door such as those used, for example, in garages, factories, aircraft hangars, trains, elevators, etc. A bracket 502 is fastened to the leading edge 501*a* of the door for mounting the safety sending edge system. The safety sensing edge system 500 includes a pressure activated switching device 510 incorporating first and second conductive layers separated by the standoff described herein. The pressure activated switching device 510 can be, for example, switching devices 100 or 400 described above, or may include a standoff such as illustrated in FIGS. 4 or 5, or combinations thereof. A resiliently compressible polymeric foam block 505 serves as a sealing gasket when the door is closed to provide for compression against the floor or door threshold plate to prevent the entry of rain, wind, small mammals, etc. The foam gasket 505 and switching device 510 are sealed within a housing 506 fabricated from a strong flexible material such as, e.g., polyvinyl chloride. A fin 503 serves to connect the housing 506 to the bracket 502. Clamping fixture 504 provides additional structural support for the fin 503. When the safety sensing edge system is used on a revolving door to positions of the pressure activated switching device 510 and the foam gaseket are preferably reversed such that the gasket 505 is positioned between the switching device 510 and fin 503. Electrical wire leads (not shown) from the switching device 510 are connected to a control circuit (not shown) for operating the door 501. Suitable circuitry is known to those with skill in the art. For example, if there is an object (e.g., a person, animal, vehicle, etc.) in the path of the leading edge 501*a* of the moving door, upon contact with the object, foam gasket 505 compresses, and the compression force is transmitted to the switching device 510, which is thereby activated, closing the electrical circuit as explained above. This sends a signal to the control circuitry which may then stop or reverse the movement of door 501.

While the above description contains many specifics, these specifics should not be construed as limitations on the scope of the invention, but merely as exemplifications of preferred embodiments thereof. Those skilled in the art will envision many other possible variations that are within the scope and spirit of the invention as defined by the claims appended hereto.

What is claimed is:

1. A pressure activated switching device which comprises:

a) a first conductive layer;

b) a second conductive layer spaced apart from the first conductive layer so as to define a planar space therebetween;

c) a standoff layer of electrically insulative material positioned between the first and second conductive layers, the standoff layer including at least one opening for permitting movement therethrough of one or the other of said first and second conductive layers, the at least one opening being defined by an interior edge of the standoff layer which laterally circumscribes an interior space, the opening including at least one linear projection extending laterally from the interior edge into the interior space.

2. The device of claim 1 wherein the standoff layer is fabricated from an elastomeric polymeric foam material.

3. The device of claim 1 wherein the standoff layer is a rigid or elastomeric solid material.

4. The device of claim 3 wherein the standoff layer is fabricated from a synthetic polymer or natural rubber.

5. The device of claim 1 wherein the standoff layer includes a plurality of elongated openings oriented lengthwise so as to define a longitudinal direction.

6. The device of claim 5 wherein at least some of the openings include at least three linear projections extending laterally from major edges of the openings and alternatingly from the major edges so as to define an interdigitated pattern.

7. The device of claim 6 wherein the linear projections are oriented parallel to each other and extend in a direction transverse to the longitudinal direction.

8. The device of claim 6 wherein the standoff layer has a thickness of from between about 1/64 inch to about 12 inches.

9. The device of claim 1 wherein the standoff layer includes a plurality of circular openings.

10. The device of claim 9 wherein at least some of the circular openings include at least three linear projections.

11. The device of claim 10 wherein the linear projections extend radially inward from the interior edge.

12. The device of claim 11 wherein the linear projections are equally spaced.

13. The device of claim 9 wherein the circular openings are all of the same diameter.

14. The device of claim 9 wherein the circular openings are not all of the same diameter.

15. The device of claim 1 further including an insulative cover layer and an insulative base layer peripherally sealed to the insulative cover layer so as to form an enclosed space, said first conductive layer, standoff layer, and second conductive layer being positioned in said enclosed space.

16. The device of claim 15 wherein said cover layer and said base layer are fabricated from a material selected from the group consisting of synthetic rubber, natural rubber, polyurethane, silicone and polyvinyl chloride.

17. The device of claim 1 wherein the first conductive layer and second conductive layer each comprise a metal film.

18. The device of claim 1 wherein the first conductive layer and second conductive layer each comprise a conductive elastomeric material.

19. The device of claim 1 further including a layer of piezoresistive material positioned between said first conductive layer and said standoff layer.

20. A safety sensing edge system for a door comprising:

a) A pressure activated switching device which includes, i) a first conductive layer, ii) a second conductive layer, iii) a standoff layer of electrically insulative material positioned between the first conductive layer and the second conductive layer, said standoff including at least one opening for permitting movement therethrough of one or the other of said first and second conductive layers, the at least one opening being defined by an interior edge of the standoff layer which laterally circumscribes an interior space, the opening including at least one linear projection extending laterally from the interior edge into the interior space, wherein the standoff layer includes a plurality of elongated openings oriented lengthwise so as to define a longitudinal direction, wherein at least some of the openings include at least three linear projections extending laterally from major edges of the openings and alternatingly from the major edges so as to define an interdigitated pattern, and wherein the linear projections are oriented parallel to each other and extend in a direction transverse to the longitudinal direction;

b) a cover for enclosing the pressure activated switching device; and c) a bracket for mounting the pressure activated switching device.

21. The safety sensing edge system of claim 20 wherein the electrically insulative material is a polymeric foam.

22. The safety sensing edge system of claim 21 wherein the standoff layer is a rigid or elastomeric solid material.

23. The safety sensing edge system of claim 22 wherein the standoff layer is fabricated from a synthetic polymer or natural rubber.

24. The safety edge system of claim 20 wherein the pressure activated switching device includes a piezoresistive material positioned between the first conductive layer and the standoff layer.

25. The safety edge system of claim 20 further including a movable door having a leading edge, wherein said pressure activated switching device is mounted to the leading edge of the movable door.

* * * * *